United States Patent [19]

Meistrell

[11] Patent Number: 4,915,046

[45] Date of Patent: Apr. 10, 1990

[54] SEAM CONSTRUCTION FOR CONNECTING ELASTOMERIC FOAM SHEETS

[75] Inventor: William R. Meistrell, Manhattan Beach, Calif.

[73] Assignee: Dive N'Surf, Inc., Hermosa Beach, Calif.

[21] Appl. No.: 272,924

[22] Filed: Nov. 18, 1988

[51] Int. Cl.[4] ..... B32B 7/08; A41D 27/24

[52] U.S. Cl. ..... 112/419; 2/275; 2/2.1 A

[58] Field of Search ..... 112/418, 419, 137, 138; 2/275, 2.1 A

[56] References Cited

U.S. PATENT DOCUMENTS

| | | | |
|---|---|---|---|
| 2,651,049 | 9/1953 | Burkhard | 112/419 |
| 4,190,010 | 2/1980 | Bibby | 112/419 |
| 4,272,851 | 6/1981 | Goldstein | 2/275 X |
| 4,535,017 | 8/1985 | Kuckein et al. | 112/419 |
| 4,753,182 | 6/1988 | Blackburn | 112/419 |

FOREIGN PATENT DOCUMENTS 3231967 3/1984 Fed. Rep. of Germany ..... 2/275

*Primary Examiner*—H. Hampton Hunter

*Attorney, Agent, or Firm*—William W. Haefliger

[57] ABSTRACT

Structure for retaining and confining the side-by-side edges and edge portions of stretchable elastomer sheets, comprises, in combination with the sheets, edges and edge portions:

(a) a stretchable smooth surfaced band folded into U-shape over such edges to define band portions extending at opposite outer sides of the sheet side-by-side edge portions, (b) and stitching extending through those folded band portions and through the sheet edge portions in spaced relation to the sheet edges, the stitching tightened to locally compress the sheets along a linear zone extending parallel to such edges and spaced therefrom, the edges and edge portions then everywhere confined and covered by the U-shaped band.

7 Claims, 1 Drawing Sheet

SEAM CONSTRUCTION FOR CONNECTING ELASTOMERIC FOAM SHEETS

BACKGROUND OF THE INVENTION

This invention relates generally to interconnection of flexible, stretchable elastomeric sheets or panels, as for example are employed in the construction of wet suits worn by surfers, and divers, and which may also be employed for other purposes. More particularly, it concerns the construction of such seams to avoid irritation to the wearer.

Contemporary wet suits and other clothing may typically be constructed of thin sheets or panels of foamed elastomeric material, such as Neoprene. The edges of such panels are conventionally attached together and the seam thus formed is presented toward the skin of the wearer. It is found that the close together stitches wrapped over the panel edges come into compressive and rubbing contact with the skin due to wet suit stretching, and causes irritation, especially as the wearer's body flexes. There is need for a seam connection of such panels which overcomes the irritation problem.

SUMMARY OF THE INVENTION

It is a major object of the invention to provide a seam connection of sheets or panels of foamed elastomeric material which overcomes the above problems, and which is easily formed and comfortable. Basically, the invention is embodied in the provision of means for retaining and confining the side-by-side edges and edge portion of stretchable elastomeric sheets, such means comprising:

(a) a stretchable, smooth-surfaced band folded into U-shape over said edges to define band portions extending at opposite outer sides of the sheet side-by-side edge portions, (b) and stitching extending through said folded band portions and through the sheet edge portions in spaced relation to the sheet edges, the stitching tightened to locally compress the edges and spaced therefrom, the edges and edge portions then everywhere confined and covered by said U-shaped band.

The two sheets are typically stretchable and may consist of Neoprene foam; and the band is also typically stretchable, and may consist of LYCRA SPANDEX.

It is a further object to provide the assembly as described wherein the total thickness of the locally confined sheets and the band at said zone is substantially less than the uncompressed thickness of either of the sheets.

In use, the confined sheet edge portions and edges, and the bulk of the U-shaped band, are typically folded along a hinge line defined by the stitching, to sidewardly engage one of the sheets, and to be received in a pocket then formed by the two sheets. In this condition, the two sheets or panels are typically stretched against the body or skin of the wearer, and the seam is non-irritating and smooth-feeling to the wearer.

These and other objects and advantages of the invention, as well as the details of an illustrative embodiment, will be more fully understood from the following specification and drawings, in which:

DRAWING DESCRIPTION

DETAILED DESCRIPTION

Figure 1:
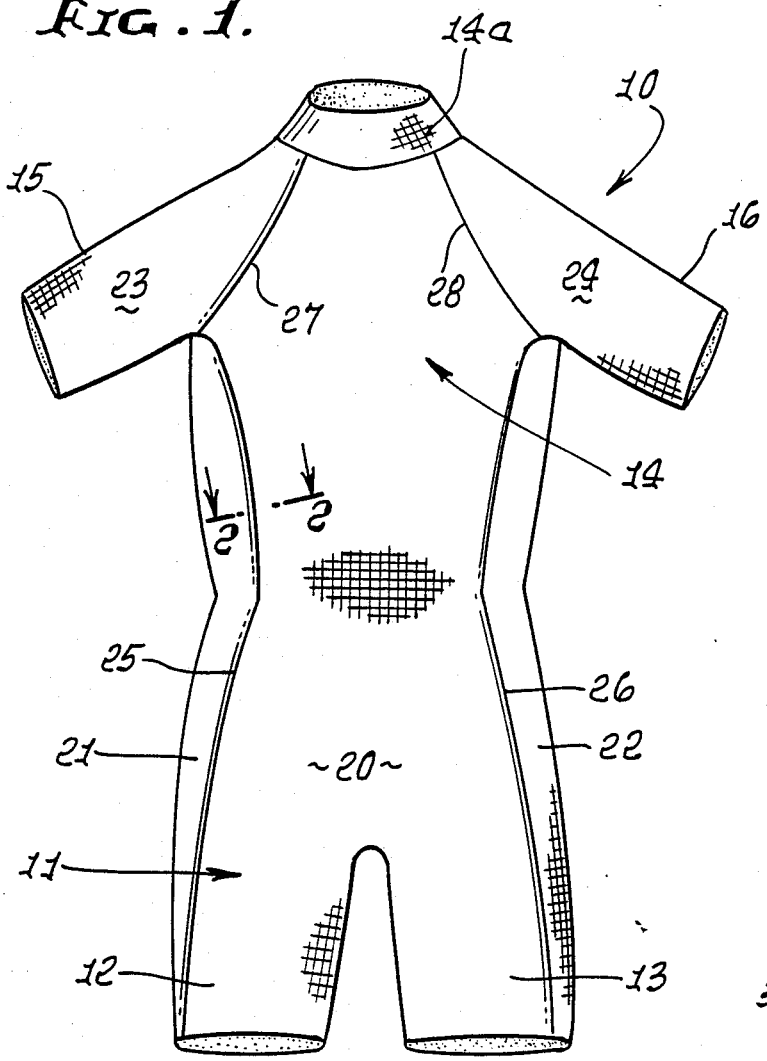
FIG. 1 is a front illusatration showing a wet suit incorporating the invention.

In FIG. 1, the wet suit 10 has a close fitting lower trunk portion 11, leg portions 12 and 13 integral with the lower trunk portion and protruding downwardly to grip the user's legs, and upper trunk portion 14 and neck portion 14*a*, and first and second arm gripping arm portions 15 and 16 integral with the upper trunk portion. The wet suit typically consists of flexible, compressible, heat insulating sheet material, such as elastomer foam, an example being Neoprene. The suit is typically assembled from panels of such material, as indicated at 20, 21, 22, 23, and 24, with similar panels at the suit rear sides. The panels are interconnected at elongated seams, indicated at 25, 26, 27, and 28, these being representative only (i.e. other panel shapes and seam locations can be employed). In the past, the seam was formed by stitching through adjacent panel edge portions, and carrying or wrapping the stitches over the panel edges; however, such thread stitches were then exposed to the wearer's skin, and could cause irritation along sensitive skin areas adjacent the elongated, stitched together edges, especially as the wearer flexed his body.

Figure 2:
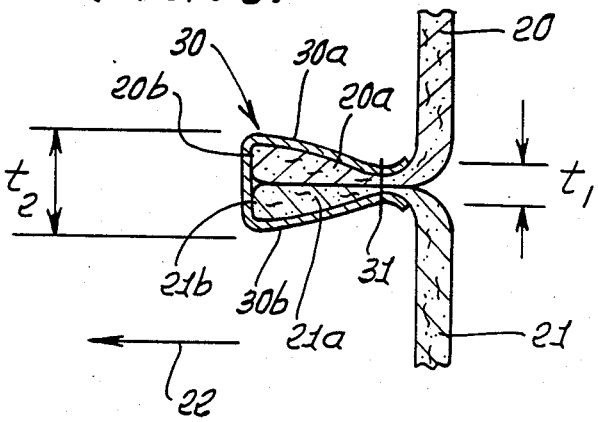
FIG. 2 is an enlarged section taken on lines 2—2 of FIG. 1.

FIG. 2 shows in enlarged section means for preventing such irritation, in accordance with the invention. As illustrated, the two panels 20 and 21 have adjacent, side-by-side edge portions 20*a* and 21*a* that terminate at edges 20*b* and 21*b*. These project inwardly in direction 22, i.e. toward the user's skin, indicated in FIG. 3 at 33.

A stretchable, smooth-surfaced, thin, flexible band 30 is provided to protect and cover the panel edge portions and edges 20*a*, 20*b*, 20*b*, and 21*b*, as shown. The band is folded into U-shaped over edges 20*b* and 21*b* to define band portions 30*a* and 30*b* in the form of thin walls extending at opposite outer sides of the sheet edge portions 20*a* and 21*a*.

Further, stitching 31 formed by threads extends through the folded band walls 30*a* and 30*b*, and also through the sheet edge portions, in spaced relation to the sheet edges 20*b* and 21*b*; and the stitching is tightened to locally compress the sheets 20 and 21 along a linear zone, i.e. along the seam thus defined between the panels (see seam 25). The stitch zone is parallel to the edges 20*b* and 21*b*, and such edges and the edge portion 20a and 21a are everywhere confined and covered by the U-shaped, smooth-shaped band 30, which is slidable along the wearer's skin without irritating same. the band may advantageously consist of the known fabric LYCRA SPANDEX, which is stretchable bi-directionally. It thus stretches with the bi-directionally stretchable sheets 20 and 21, as the wearer's body flexes (the wet suit fitting very closely to the wearer's body and typically being in stretched state, as worn; thus, the seams including the bands 30 also must stretch).

Figure 3:
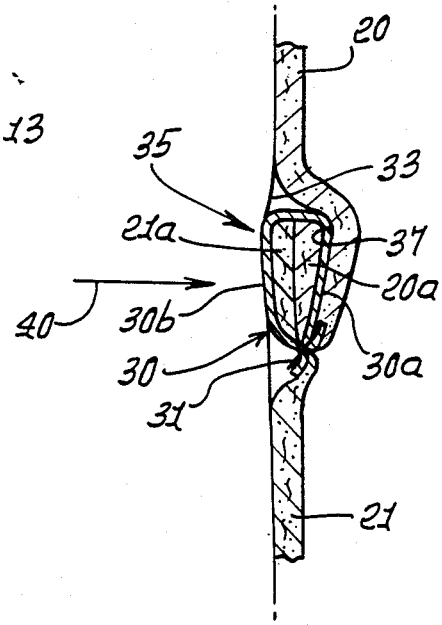
FIG. 3 is a view like FIG. 2 showing a folded configuration.

FIG. 3 illustrates lateral folding of the U-shaped band 30 and confined sheet edge portions 20*a* and 21*a* along the hinge line defined by the stitching 31. Since the stitching is tightened to substantially compress the sheets 20 and 21 at the narrow zone through which the stitching passes, it remains spaced from and out of contact with the wearer's skin 33, preventing irritation. Such compression reduces the thickness $t_1$ of the assembly at the stitch zone to less than about ½ the uncompressed total thickness $t_2$ of the assembly. See FIG. 1. Sheet thickness before compression is between 1/32 and ⅛ inch.

It will also be noted in FIG. 3 that the folded unitary assembly or unit 35 consisting of the band 30 and confined sheet edge portions 20*a* and 21*a* rests sidewardly against the inner side of one of the sheets 20 and 21 (in this case sheet 20), and the two stretched sheets then form a pocket 37 to receive the unit 35, whereby in as-worn condition, the unit 35 conforms to the user's skin surface and the stretched sheets 20 and 21, without irritation. Band smooth side 30b then engages the wearer's skin without irritation. Also, confined edge portions 20*a* and 21*a* are compressible in direction 40 within the pocket to accommodate the smooth, non-irritating fit to the wearer.

I claim:

1. Means for retaining and confining the side-by-side edges and edge portions of stretchable elastomer sheets, comprising, in combination with the sheets, edges and edge portions:

(a) a stretchable smooth surfaced band folded into U-shape over said edges to define band portions extending at opposite outer sides of the sheet side-by-side edge portions, (b) and stitching extending through said folded band portions and through the sheet edge portions in spaced relation to the sheet edges, the stitching tightened to locally compress the sheets along a linear zone extending parallel to said edges and spaced therefrom, the edges and edge portions then everywhere confined and covered by said U-shaped band, (c) each sheet resiliently compressed along said zone to less than ½ the sheet thickness in normally uncompressed state, whereby a hinge is created for folding, along said linear zone, of the confined sheet edge portions and edges, and the bulk of the U-shaped band, (d) each sheet and the band being bidirectionally stretchable, whereby the hinge is also stretchable along said linear zone.

2. The combination of claim 1 where said sheets consist of Neoprene foam, or the like.

3. the combination of claim 2 wherein the sheets are folded to extend generally oppositely away from said zone.

4. The combination of claim 2 wherein each sheet has thickness between about 1/32 inch and ⅛ inch.

5. The combination of claim 1 wherein the band consists of LYCRA, or the like.

6. The combination of claim 1 wherein the confined edge portions and edges, and the bulk of the U-shaped band, are folded along a hinge line defined by the stitching, to engage one of the sheets, and to be received in a pocket then formed by the two sheets.

7. The combination of claim 6 wherein the two sheets are stretched, while forming the pocket.

* * * * *